US010914116B2

(12) United States Patent
Kwon

(10) Patent No.: US 10,914,116 B2
(45) Date of Patent: Feb. 9, 2021

(54) AUTOMATIC FOLDABLE DOOR OF DETACHABLE TYPE FOR SHOWCASE

(71) Applicant: Sang-Woo Kwon, Seongnam-si (KR)

(72) Inventor: Sang-Woo Kwon, Seongnam-si (KR)

( * ) Notice: Subject to any disclaimer, the term of this patent is extended or adjusted under 35 U.S.C. 154(b) by 0 days.

(21) Appl. No.: 16/758,578

(22) PCT Filed: Aug. 3, 2018

(86) PCT No.: PCT/KR2018/008841
§ 371 (c)(1),
(2) Date: Apr. 23, 2020

(87) PCT Pub. No.: WO2019/098497
PCT Pub. Date: May 23, 2019

(65) Prior Publication Data

US 2020/0347670 A1 Nov. 5, 2020

(30) Foreign Application Priority Data

Nov. 16, 2017 (KR) ..... 10-2017-0153241

(51) Int. Cl.
*A47F 3/04* (2006.01)
*E05F 17/00* (2006.01)
(Continued)

(52) U.S. Cl.
CPC ..... *E06B 9/04* (2013.01); *A47F 3/043* (2013.01); *A47F 3/0478* (2013.01); *A47F 3/125* (2013.01);
(Continued)

(58) Field of Classification Search
CPC ..... E06B 9/04; E05F 15/611; E05F 17/004
See application file for complete search history.

(56) References Cited

U.S. PATENT DOCUMENTS 4,341,083 A * 7/1982 Ibrahim ..... A47F 3/043 49/340
9,668,591 B2 * 6/2017 Giulietti ..... E05F 15/611
(Continued)

FOREIGN PATENT DOCUMENTS

CN 10-1871309 A 10/2010
JP 2001-164847 A 6/2001
(Continued)

*Primary Examiner* — Kimberley S Wright
(74) *Attorney, Agent, or Firm* — John K. Park; Park Law Firm

(57) ABSTRACT

Disclosed is an automatic detachable door of a detachable type for a showcase. The automatic detachable door includes a plurality of foldable screens (30), of which a cover cap (40) is respectively fitted into upper and lower portions of the respective foldable screens (30), a first fitting protrusion (41) is mounted to one side of the upper cover cap (40), and a second fitting protrusion (47) is mounted to one side of the lower cover cap (40); and upper and lower frames (20 and 22) which are provided with a plurality of fitting holes (23) at a certain interval. Power transmission members (70) are fitted into the fitting holes (23) of the upper frame (20). A center of the power transmission member (70) is provided with a protrusion receiving hole (71) for receiving the first fitting protrusion (41). Two rod receiving holes (73) are formed at symmetric positions at an equal distance from a center the protrusion receiving hole (71). A coil spring (81) and a powered rod (80) are sequentially inserted into the respective rod receiving holes (73). An upper portion of the protrusion receiving hole (71) is provided with a locking shoulder (72) on which a holding bolt (46) for holding the first fitting protrusion (41) is seated. An upper portion of the first fitting protrusion (41) is provided at a center thereof with a fastening hole (45) to which the holding bolt (46) is fastened. A lower portion of the first fitting protrusion (41) is provided with a protrusion body (42) having an outer
(Continued)

diameter larger than an outer diameter of the first fitting protrusion (41). A top surface of the protrusion body (42) is provided with two seating holes (43) at two symmetric positions at an equal distance from the center of the first fitting protrusion (41), in which the seating holes (43) are formed to receive front ends of the rods (80). The protrusion body (42) is engaged to a protrusion body seating member (44) formed on a top surface of the cover cap (40). The plurality of foldable screens (30) are simultaneously opened or closed by a rotating member mounted to the upper frame (20).

3 Claims, 12 Drawing Sheets

(51) Int. Cl.

| | |
|---|---|
| ***E06B 9/04*** | (2006.01) |
| ***E05F 15/611*** | (2015.01) |
| ***A47F 3/12*** | (2006.01) |

(52) U.S. Cl.
CPC ..... *E05F 15/611* (2015.01); *E05F 17/004* (2013.01); *E05F 2017/008* (2013.01); *E05Y 2900/202* (2013.01)

(56) References Cited

U.S. PATENT DOCUMENTS

| | | | | |
|---|---|---|---|---|
| 9,814,327 | B2 * | 11/2017 | Giulietti | E05F 17/004 |
| 2012/0291471 | A1 * | 11/2012 | Giulietti | A47F 3/0404 62/255 |
| 2016/0309918 | A1 * | 10/2016 | Giulietti | A47F 3/004 |
| 2016/0309919 | A1 * | 10/2016 | Giulietti | A47F 3/0478 |

FOREIGN PATENT DOCUMENTS

| | | | |
|---|---|---|---|
| JP | 2009-197562 | A | 9/2009 |
| KR | 10-1196261 | B1 | 11/2012 |
| KR | 10-1290769 | B1 | 7/2013 |

* cited by examiner

【Fig. 1】
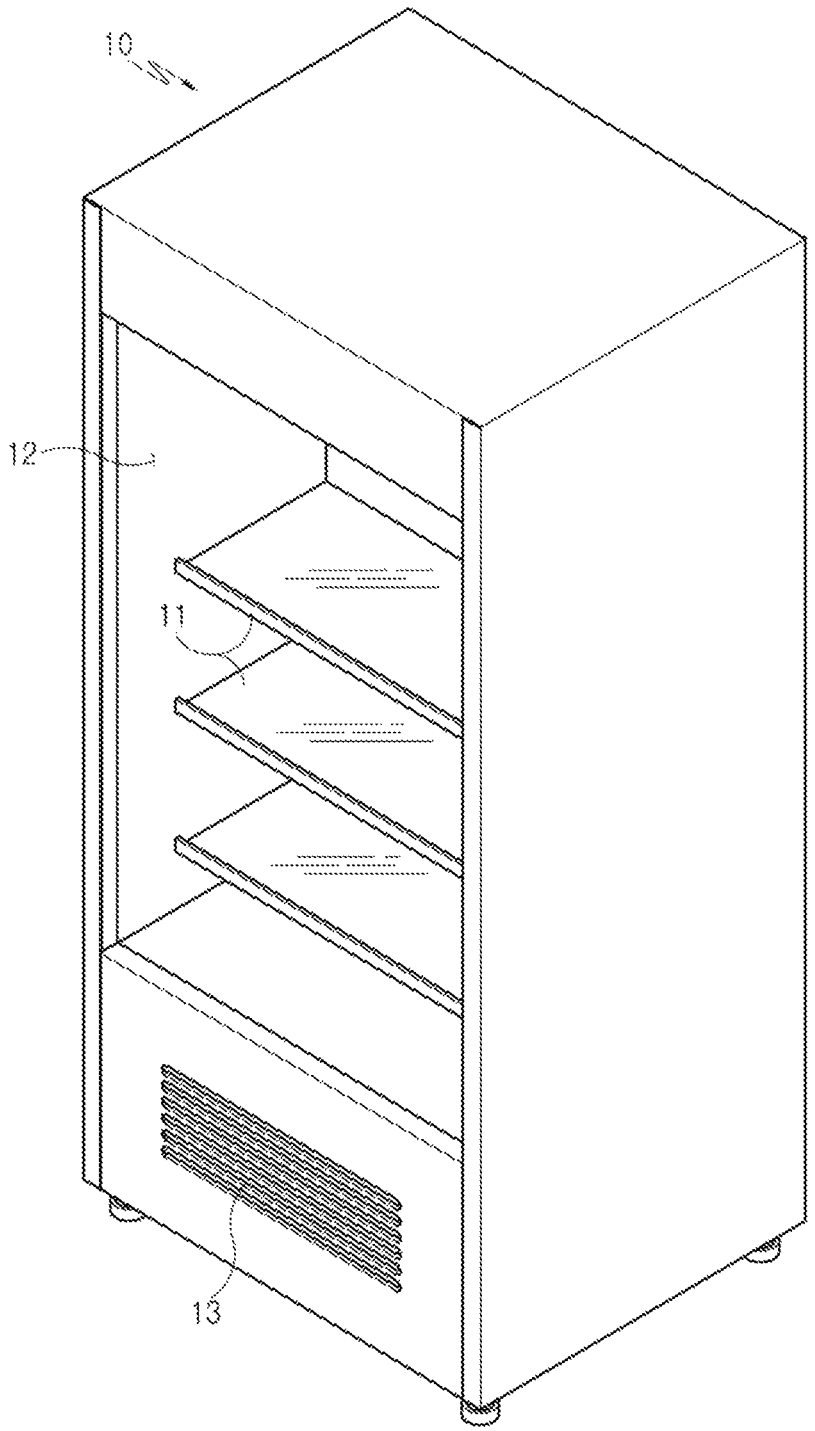

【Fig. 2】
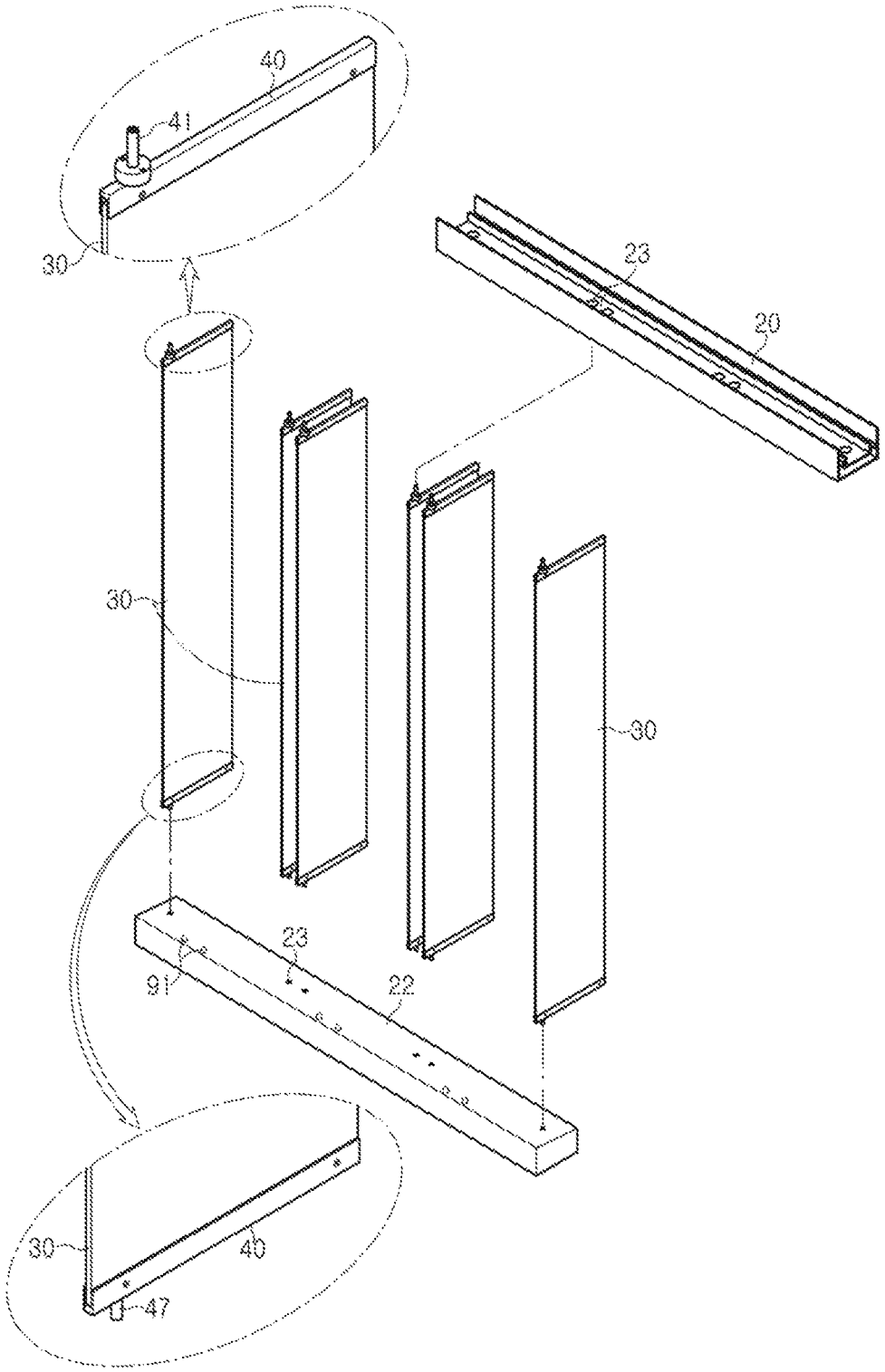

【Fig. 3】
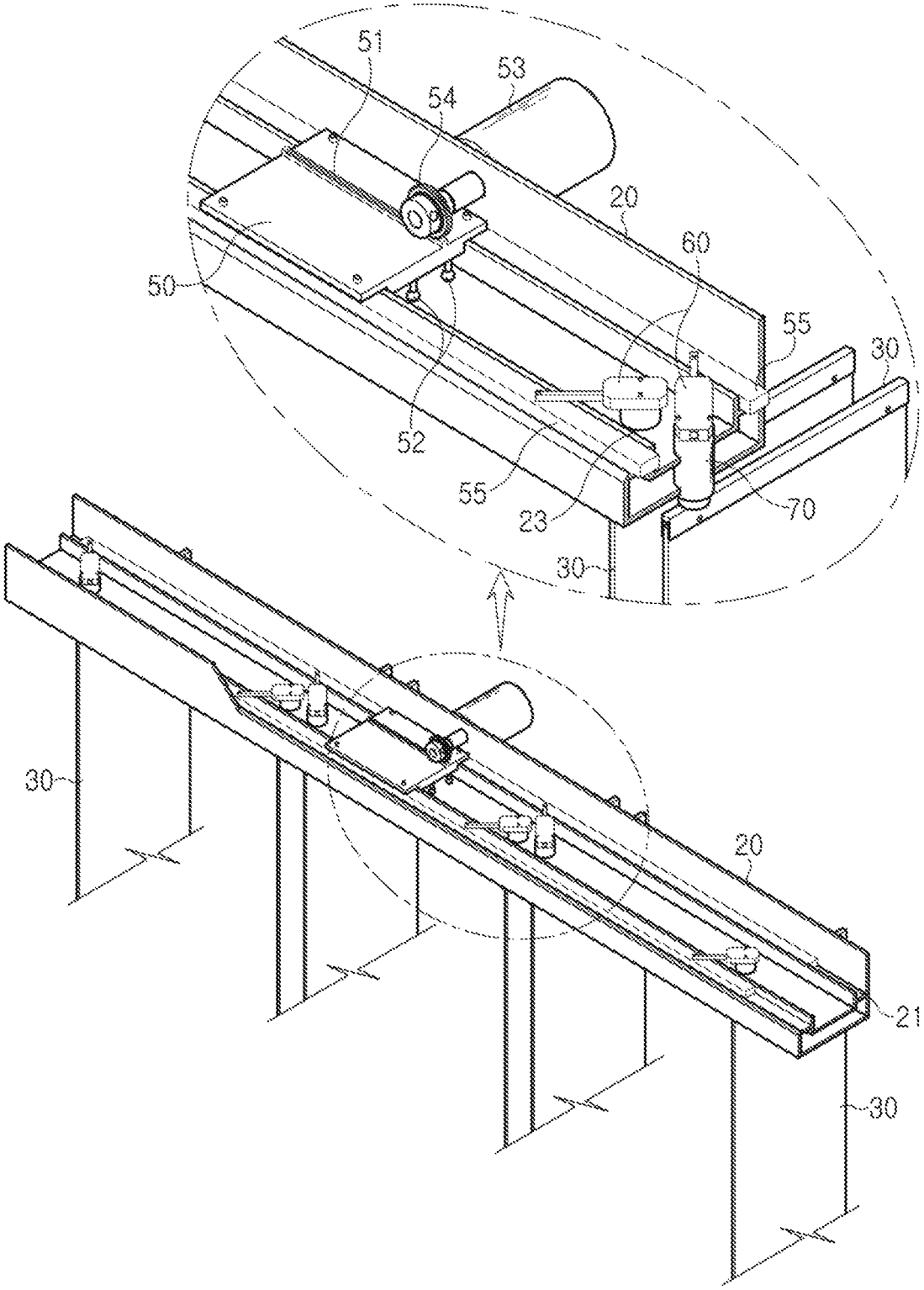

【Fig. 4】
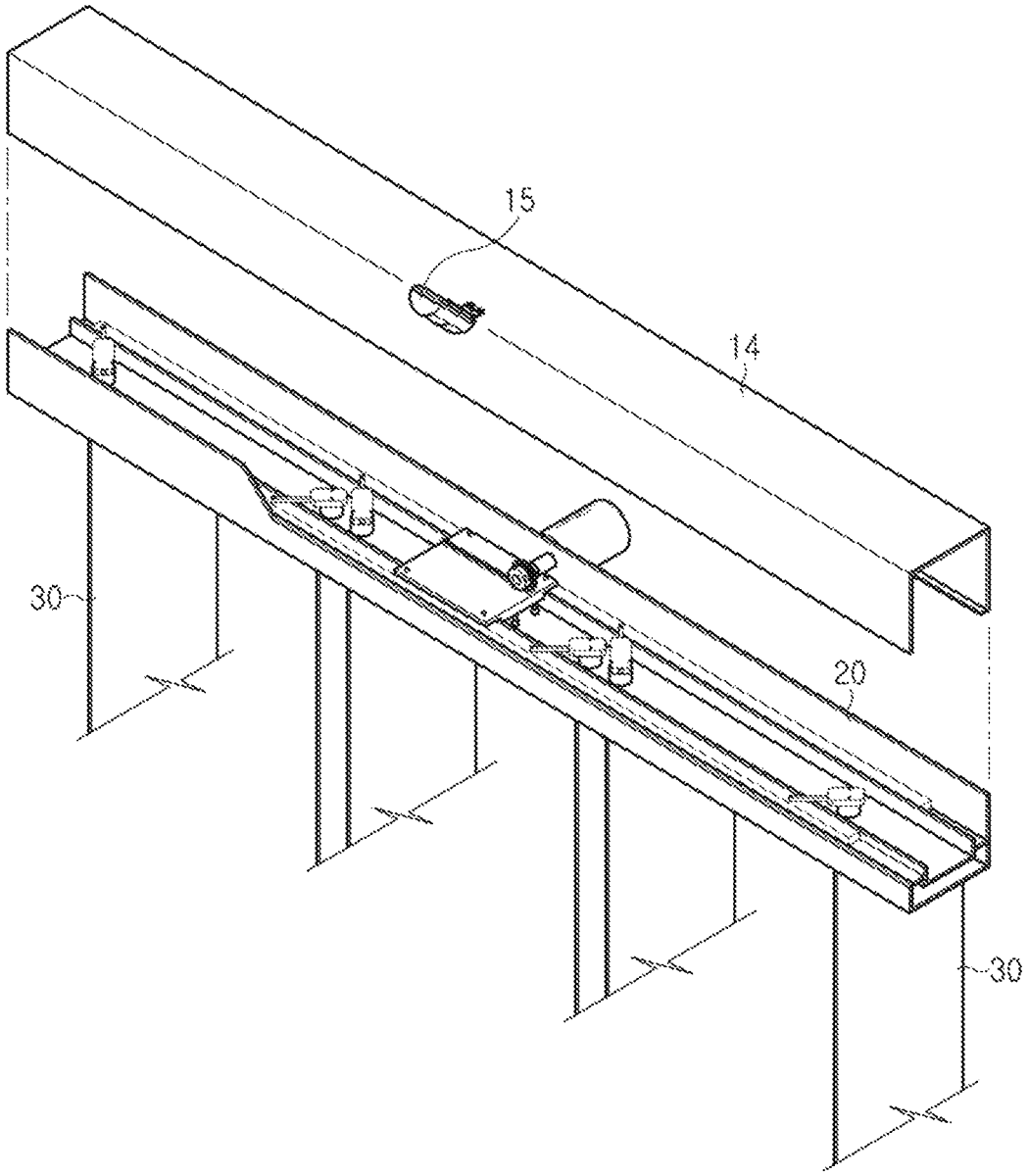

【Fig. 5】
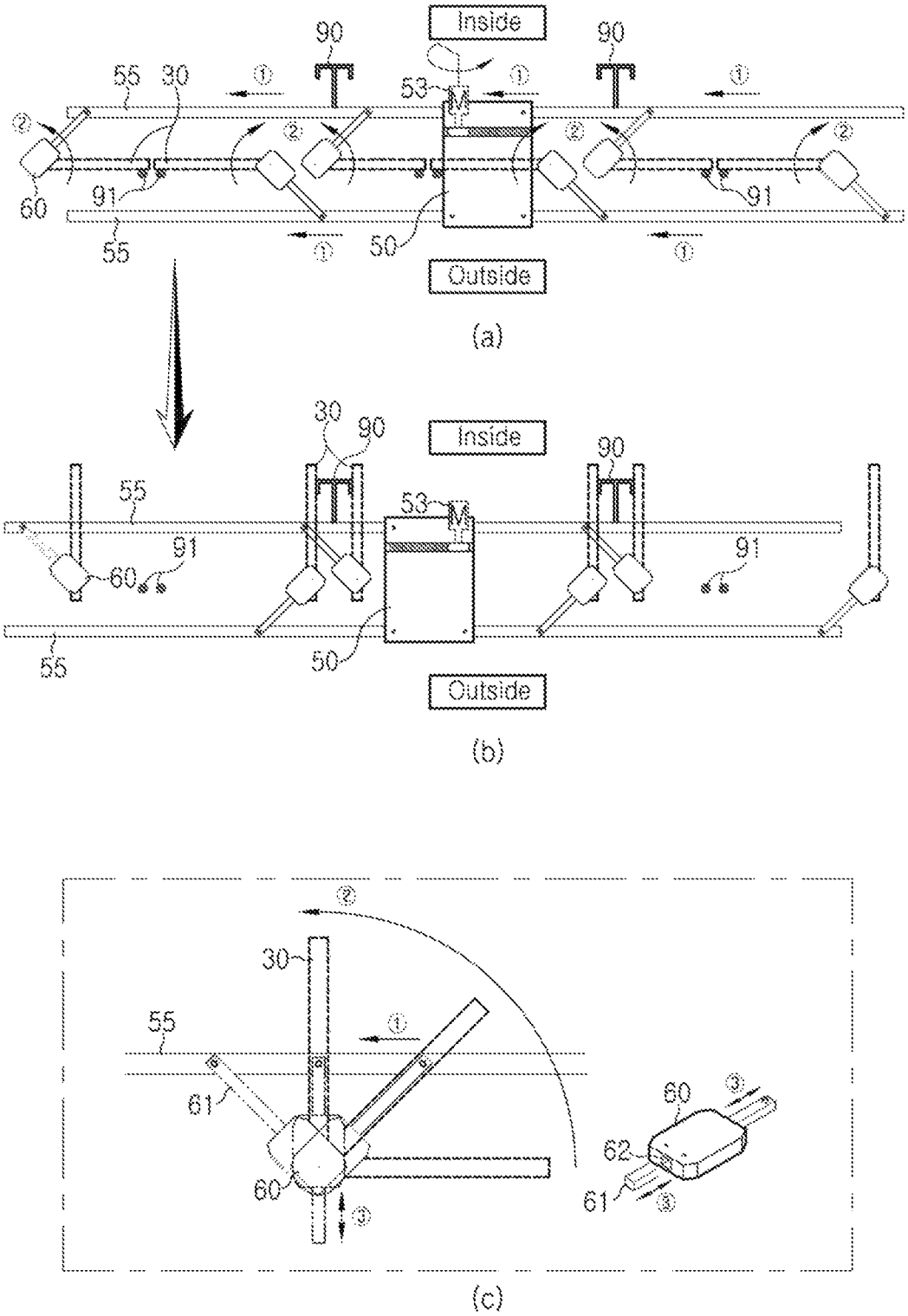

【Fig. 6】
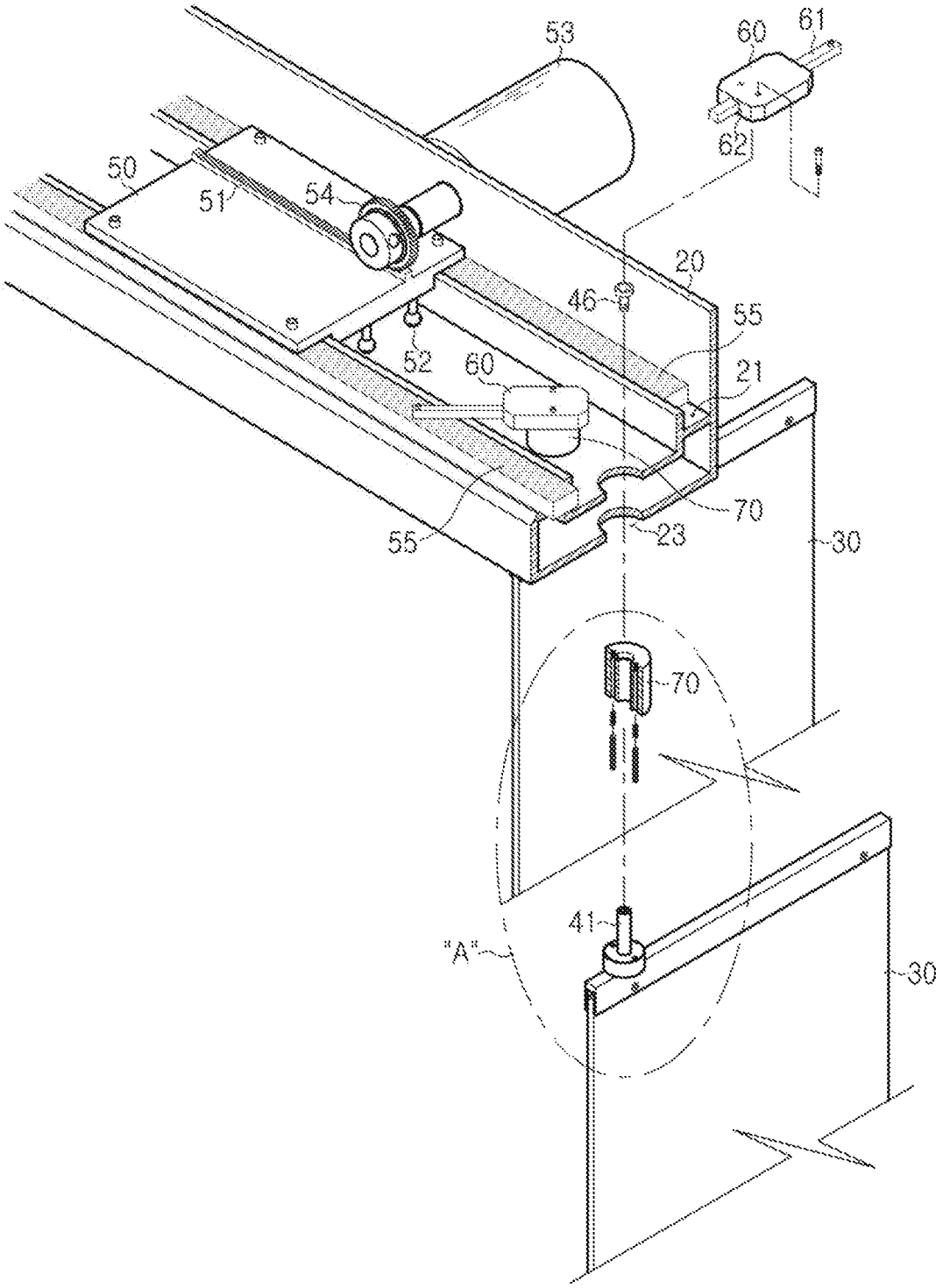

【Fig. 7】
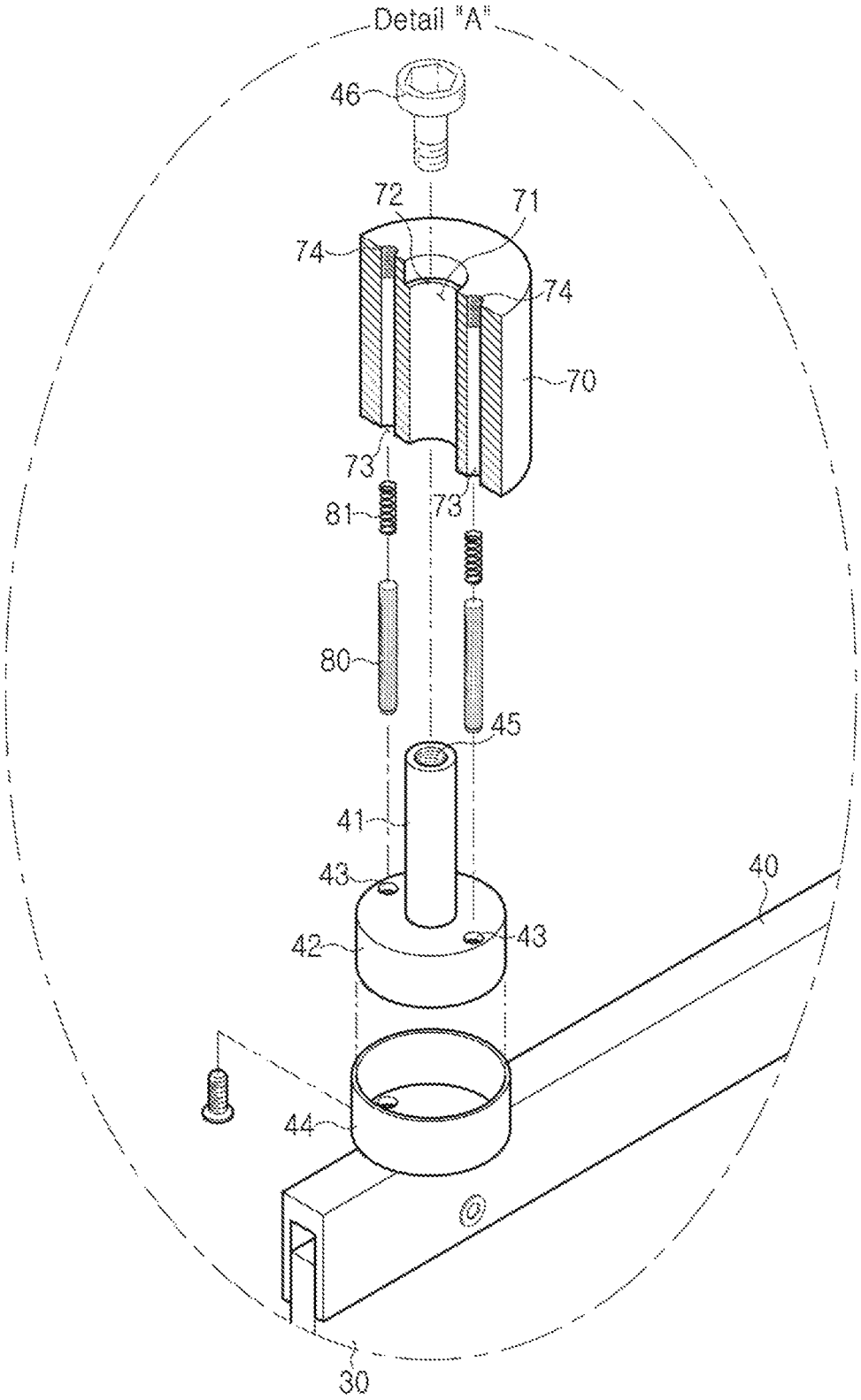

【Fig. 8】
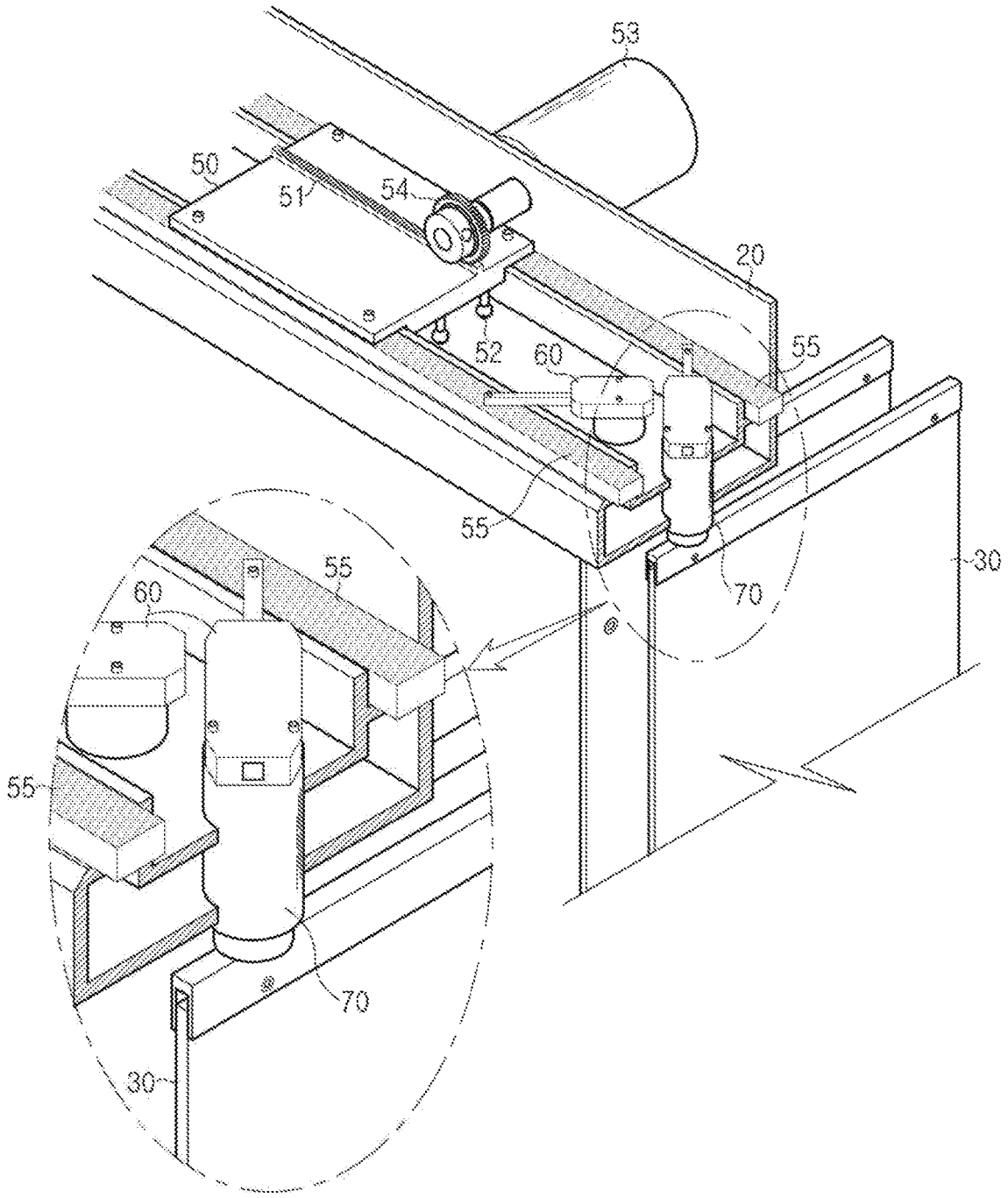

【Fig. 9】
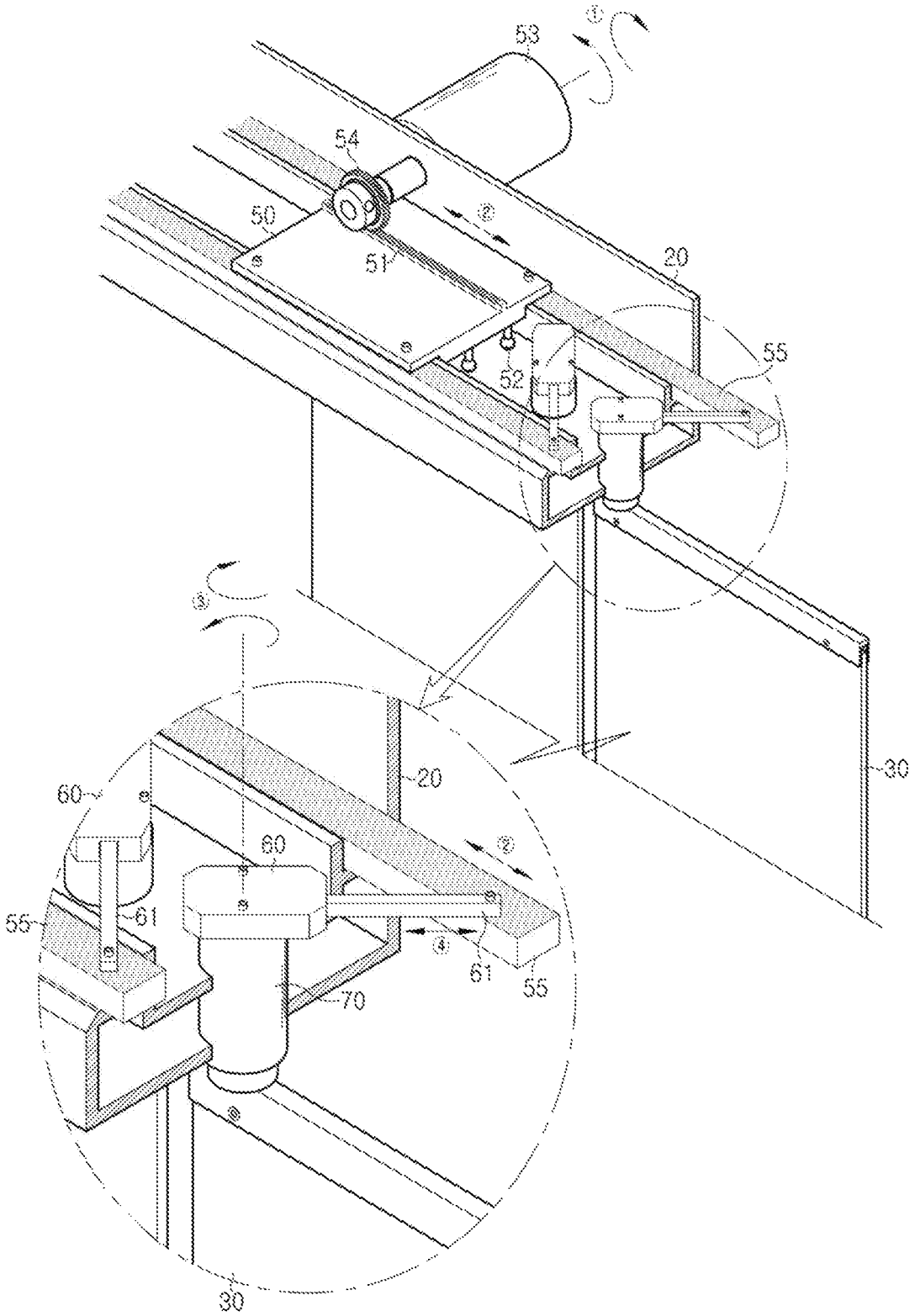

【Fig. 10】
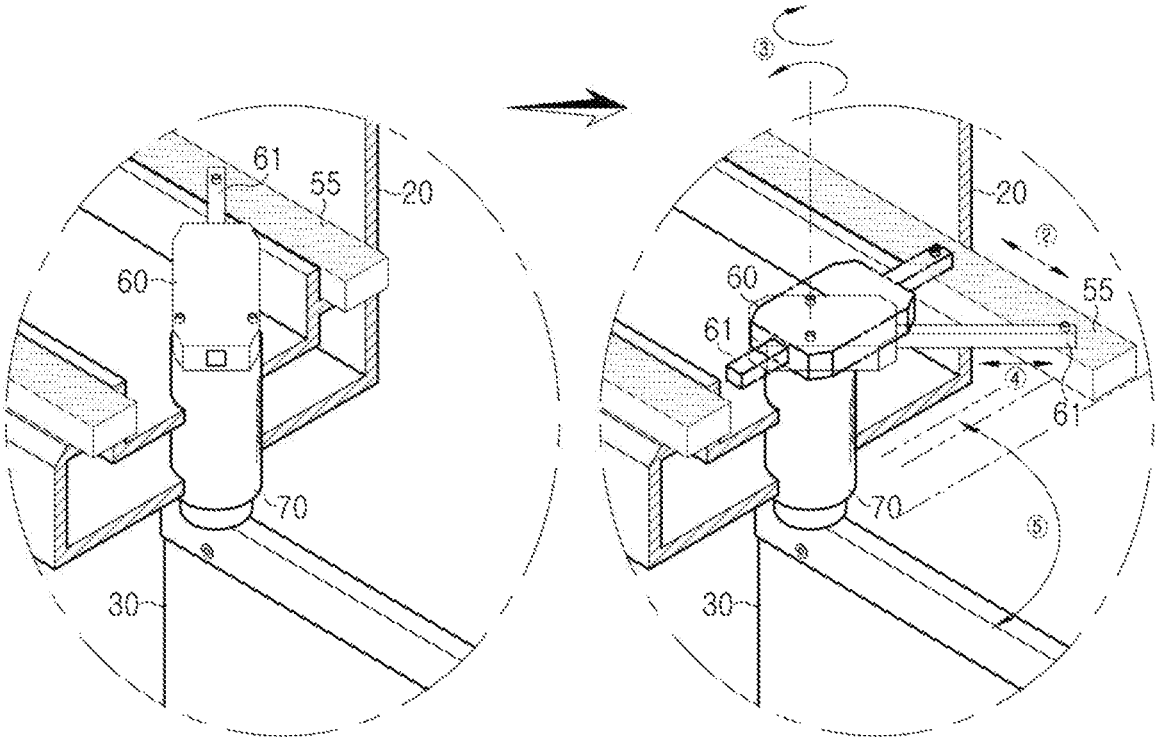

【Fig. 11】
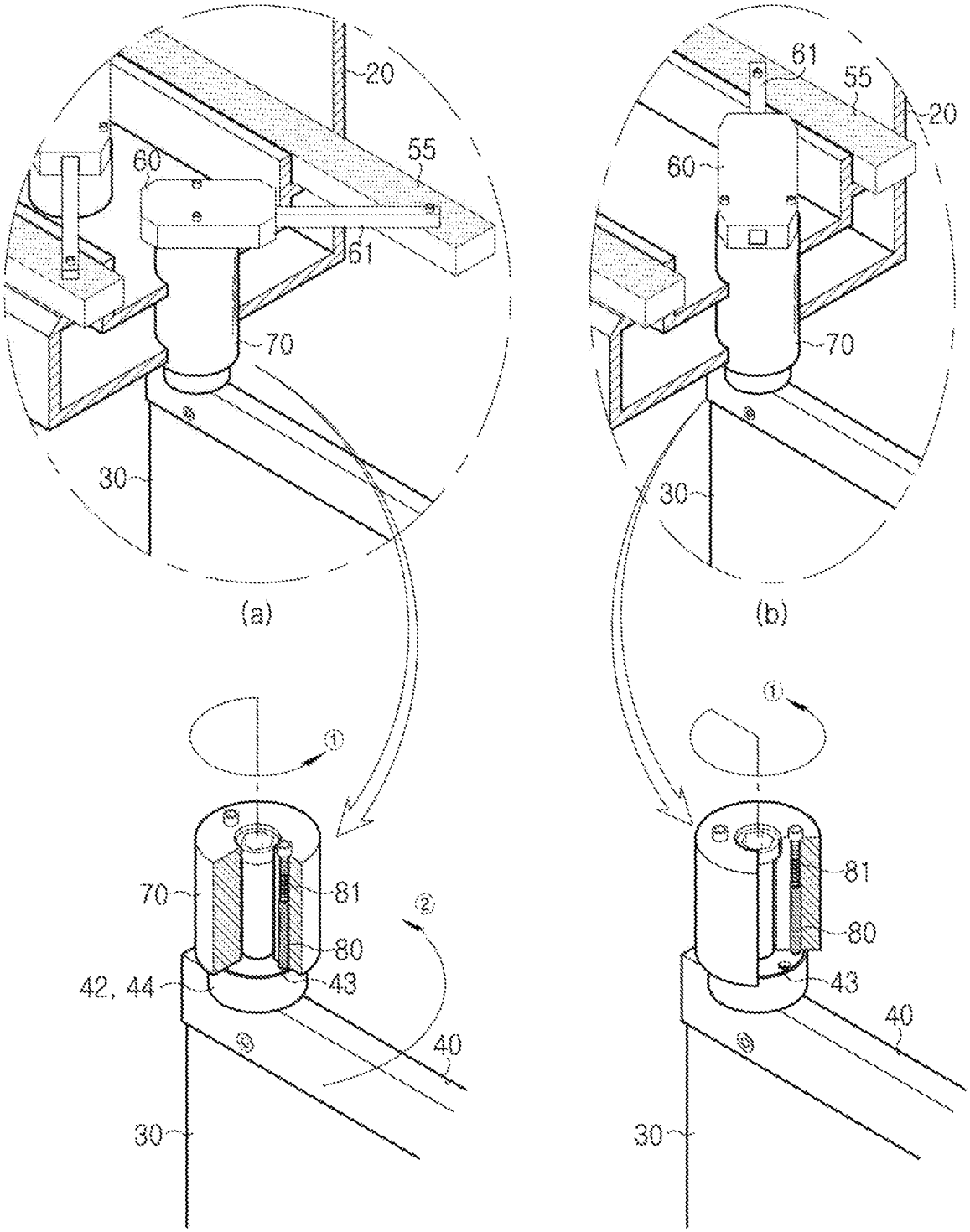

【Fig. 12】
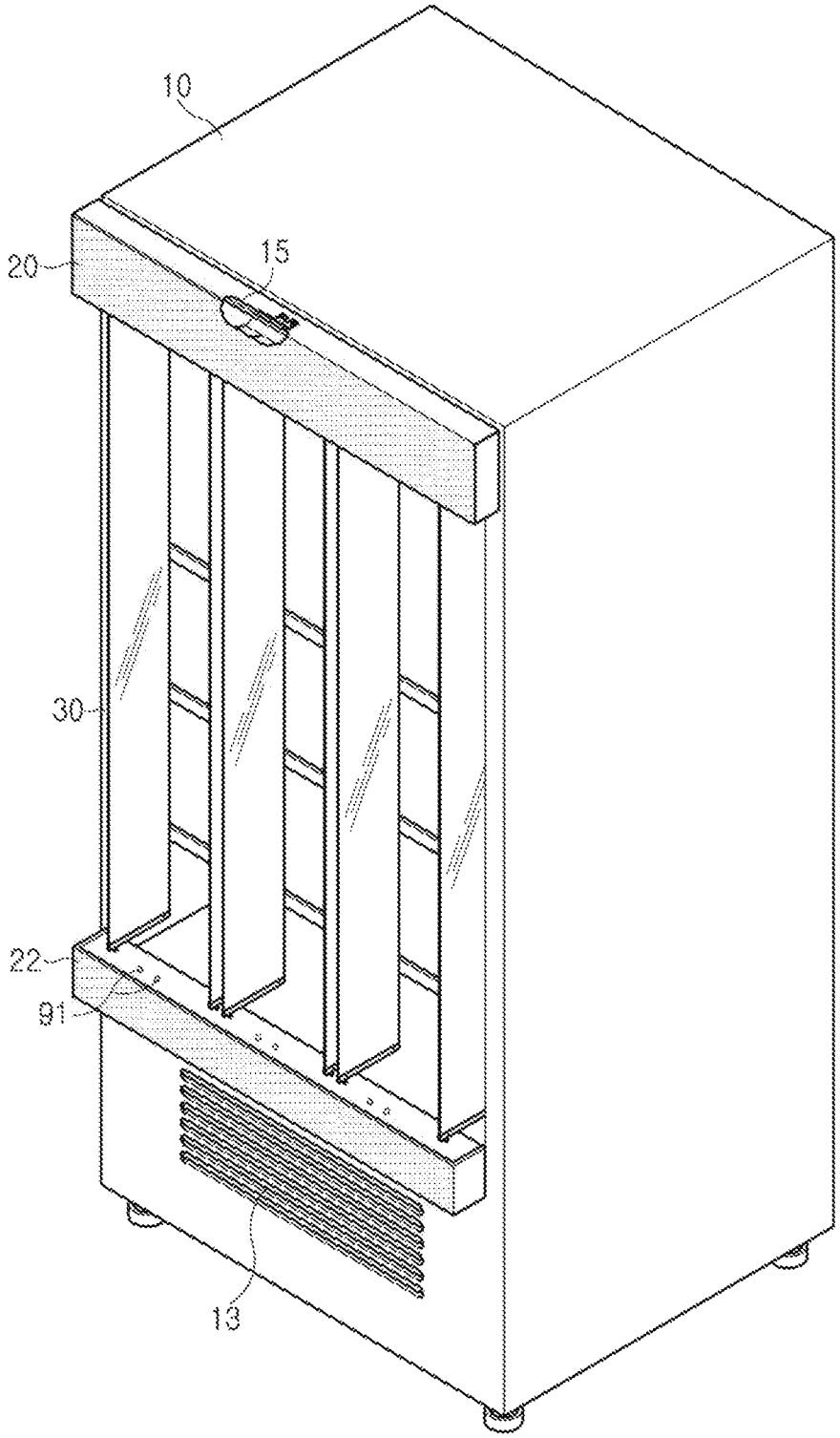

AUTOMATIC FOLDABLE DOOR OF DETACHABLE TYPE FOR SHOWCASE

BACKGROUND OF THE INVENTION

Field of the Invention

The present invention relates to a door for a showcase, and more particularly, to an automatic foldable door of a detachable type for a showcase that is installed on a front surface of an open-type showcase with no door, and is automatically folded or unfolded according to detection of a sensor to keep an inside of the showcase more clean and fresh, as well as reducing an amount of electricity used, in which if a certain foldable screen is braked by an external force while a plurality of foldable screens are folding or unfolding, operation of the certain foldable screen can be temporarily stopped for safety of a user.

Background of the Related Art

FIG. 1 is a perspective view illustrating an open-type showcase 10 according to the related art. The open-type showcase 10 is configured to display various kinds of beverages and foods, which should be kept under refrigeration, in a fresh state for a long time at convenience stores, bakeshops or the like. As illustrated in FIG. 1, the showcase 10 includes a plurality of display shelves 11, a display space 12 for housing the plurality of stacked display shelves 11, and a machine chamber 13 having a cooling system for generating cold air and components for maintaining the showcase.

The cooling system has a compressor, a condenser, an expansion valve, a heat exchanger and a coolant tube for connecting the components, in which a coolant is circulated through refrigeration cycles to generate cold air, and the cold air is supplied to the upper display space 12 by a fan to maintain freshness of foods and beverages put on the showcase.

The open-type showcases of the related art in FIG. 1 provided with two slidable doors installed to the front surface were commercially available at the beginning stage. Since customers suffer inconvenience in the process of opening the door to take out foods and beverages, the showcases with the slidable doors are considered improper to display foods and beverages.

An open-type showcase with no door is generally provided at the most of convenience stores and bakeshops to display foods and beverages which should be kept under refrigeration. Since the open-type showcase with no door is configured in such a way that the cold air is not kept in the display space, but is discharged outwardly, excessive usage fees for air conditioning power are paid. Also, since external dust flows in the inner space of the showcase, the open-type showcase is not proper to display fresh foods.

Sang-Woo, Kwon, Applicant and Inventor of this application, figured out and solve the problems contained in the open-type showcase, and has been continuously conducting the study of the open-type showcase. Therefore, he got patents on the open-type showcase, for example, Korean Patent Nos. 10-1196262, 10-1290769 and 10-1299479, entitled 'Automatic foldable door of detachable type for showcase'.

SUMMARY OF THE INVENTION

Therefore, the present invention has been made in view of the above problems, and Sang-Woo, Kwon, Applicant and Inventor of this application, corrected or modified partial configurations disclosed in Korean Patent Nos. 10-1196262, 10-1290769 and 10-1299479, entitled 'Automatic foldable door of detachable type for showcase'. An object of the invention is provided to an automatic foldable door of a detachable type for a showcase by employing and adding a new configuration to the above patents which obtains superior working effects.

In order to achieve the above object, according to one aspect of the invention, there is provided an automatic detachable door of a detachable type for a showcase, the automatic detachable door including: a plurality of foldable screens, of which a cover cap is respectively fitted into upper and lower portions of the respective foldable screens, a first fitting protrusion is mounted to one side of the upper cover cap, and a second fitting protrusion is mounted to one side of the lower cover cap; and upper and lower frames which are provided with a plurality of fitting holes at a certain interval, wherein power transmission members are fitted into the fitting holes of the upper frame; a center of the power transmission member is provided with a protrusion receiving hole for receiving the first fitting protrusion; two rod receiving holes are formed at symmetric positions at an equal distance from a center the protrusion receiving hole; a coil spring and a powered rod are sequentially inserted into the respective rod receiving holes; an upper portion of the protrusion receiving hole is provided with a locking shoulder on which a holding bolt for holding the first fitting protrusion is seated; an upper portion of the first fitting protrusion is provided at a center thereof with a fastening hole to which the holding bolt is fastened; a lower portion of the first fitting protrusion is provided with a protrusion body having an outer diameter larger than an outer diameter of the first fitting protrusion; a top surface of the protrusion body is provided with two seating holes at two symmetric positions at an equal distance from the center of the first fitting protrusion, in which the seating holes are formed to receive front ends of the rods; the protrusion body is engaged to a protrusion body seating member formed on a top surface of the cover cap; and the plurality of foldable screens are simultaneously opened or closed by a rotating member mounted to the upper frame.

If the automatic foldable door of the detachable type for the showcase according to the invention is employed, it is possible to protect various kinds of foods and beverages put on the showcase against alien substances coming from the outside, thereby keeping the display state more clean and fresh, to solve the problem in that the cold air for improving the freshness is excessively discharged to the outside, thereby reducing the amount of electricity used, and to easily get the advertising effect of various kinds of foods and beverages put on the showcase through the surface of the transparent foldable screens.

In addition, when the hand of the customer is held between the foldable screens which are automatically rotated, the rotating force applied to the foldable screens is rapidly extinguished to secure the safety of the customer. Also, in view of the configuration of which the automatic foldable door of the invention can be detachably installed to the conventional showcase, it is possible to provide the customers with further improved service by use of the existing facility.

BRIEF DESCRIPTION OF THE DRAWINGS

Reference is now made briefly to the accompanying drawings, in which:

FIG. 1 is a perspective view illustrating an open-type showcase according to the prior art;

FIG. 2 is an exploded perspective view illustrating an automatic foldable door of a detachable type for a showcase according to one embodiment of the invention;

FIG. 3 is a perspective view illustrating an engaging state of foldable screens and an upper frame;

FIG. 4 is a perspective view illustrating a sensor and a cover according to one embodiment of the invention;

FIG. 5 is a view illustrating an operating principle of the foldable screens according to one embodiment of the invention;

FIGS. 6, 7 and 8 are perspective views illustrating a configuration and operation of a power transmission member according to one embodiment of the invention;

FIGS. 9 and 10 are perspective views illustrating a driven rotor;

FIG. 11 is a perspective view illustrating a function of a powered rod of the power transmission member according to one embodiment of the invention; and FIG. 12 is a perspective view illustrating installation of the automatic foldable door of the detachable type for the showcase according to one embodiment of the invention.

DETAILED DESCRIPTION OF THE PREFERRED EMBODIMENT

An automatic foldable door of a detachable type for an open-type showcase according to the invention is installed to a front of the showcase, in which if a sensor detects hand motion of a customer stretching toward foods put on the showcase, a plurality of foldable screens are simultaneously folded at a right angle according to the hand motion, so that the customer can take the food out of the showcase.

The configuration and operation of the automatic foldable door of the detachable type for the showcase according to preferred embodiments of the invention will now be described in detail with reference to the accompanying drawings. In the following description, detailed descriptions of well-known functions constructions will be omitted since they would obscure the invention in unnecessary detail.

FIG. 2 is an exploded perspective view illustrating the automatic foldable door of the detachable type for the showcase according to one embodiment of the invention. As illustrated in FIG. 2, the automatic foldable door includes a plurality of foldable screens 30 to open or close a front surface of the showcase, and an upper rectangular frame 20 to support the foldable screens 30. A cover cap 40 is fitted into an upper portion of the respective foldable screens 30, as illustrated in an enlarged view indicated by the circle on an upper portion of FIG. 2, and a first fitting protrusion 41 is mounted to one side of the cover cap 40.

Also, as illustrated in an enlarged view indicated by the circle on a lower portion of FIG. 2, a cover cap 40 is fitted into a lower portion of the respective foldable screens 30, and a second fitting protrusion 47 is mounted to one side of the cover cap 40. The plurality of foldable screens 30 with the cover caps 40 fitted to the upper and lower portions are installed to fitting holes 23 formed in the upper and lower frames 20 and 22 at regular intervals.

The foldable screen 30 is preferably made of a transparent acrylic plate or a transparent film sheet of high flexibility so that a customer can easily check foods and beverages put on the showcase from the outside. If the foldable screens 30 are made of the transparent acrylic plate or the transparent film sheet, various kinds of foods and beverages put on the showcase can easily get an advertising effect.

FIG. 3 is a perspective view illustrating the engaging state of the foldable screens 30 and the upper frame 20. As illustrated in an enlarged view indicated by the circle in FIG. 3, the plurality of foldable screens 30 are installed by power transmission members 70 which are fitted into the fitting holes 23 of the upper frame 20, and a driven rotor 60 is mounted to an upper portion of the respective power transmission members 70.

Also, a rotating member for simultaneously rotating the plurality of foldable screens 30 is mounted to the upper frame 20. More specifically, both inner sides of the upper frame 20 are provided with a pair of rail grooves 21, and a rail 55 is mounted on the respective rail grooves 21 to be guided by the rail groove and linearly moved in a longitudinal direction. A main movable member 50 is engaged to the upper portion of the respective rails 50 by fastening means, and a top surface of the main movable member 50 is provided with a rack gear 51. The rack gear 51 is meshed with a pinion gear 54 installed to a shaft of a motor 53.

The main movable member 50 is linearly moved in the longitudinal direction by operation of the motor 53, and thus the rails 55 are moved in the longitudinal direction in corporation with the main movable member 50. The driven rotor 60 connected to one side of the rail 55 converts the linear movement of the main movable member 50 into rotational movement, thereby folding or unfolding the plurality of foldable screens 30 at the same time.

FIG. 4 is a perspective view illustrating a sensor 15 and a cover 14 according to the embodiment of the invention. The cover 14 is mounted to the upper portion of the upper frame 20, and the sensor 15 is mounted to an upper portion of the cover 14 to detect operation of the customer and to send a driving signal to the motor 53. The sensor 15 is commercially available, and is preferably installed to a location of the configuration which can easily detect the motion of the customer.

FIG. 5 is a view illustrating the operating principle of the foldable screens 30 according to the embodiment of the invention. FIG. 5A shows a folded state of the foldable screen 30. If the customer stretches his or her hand toward the foods or beverages put on the showcase in the folded state illustrated in FIG. 5A, the sensor 15 detects the motion of the customer to send the driving signal to the motor 53, and thus the motor 53 is driven according to the driving signal.

If the motor 53 is rotated in a counterclockwise direction, as illustrated in FIG. 5A, the main movable member 50 and the rails 55 are linearly moved in the direction indicated by the arrow ①, and the driven rotor 60 is rotated in the direction of the arrow ②, so that the plurality of foldable screens 30 are simultaneously rotated at a right angle to be folded, as a slidable door is opened, and thus the showcase is fully opened, as illustrated in FIG. 5B.

FIGS. 6, 7 and 8 are perspective views illustrating the configuration and operation of the power transmission member 70 according to the embodiment of the invention. As illustrated in FIGS. 6 and 8, the power transmission member 70 is fitted into the fitting hole 23 of the upper frame 20, and protrudes from the fitting hole 23. The driven rotor 60 is firmly mounted onto the upper portion of the power transmission member 70.

FIG. 7 is a detailed view of the circle A in FIG. 6 to show the power transmission member 70 which is vertically cut. As illustrated in FIG. 7, the center of the power transmission member 70 is provided with a protrusion receiving hole 71 for receiving the first fitting protrusion 41, and two rod receiving holes 73 are formed at two symmetrical positions at an equal distance from the center of the protrusion receiving hole 71. A coil spring 81 and a powered rod 80 are sequentially inserted into the respective rod receiving holes 73, and the upper portion of the protrusion receiving hole 71 is provided with a locking shoulder 72 on which a holding bolt 46 for holding the first fitting protrusion 41 is seated.

The upper portion of the rod receiving hole 73 is provided with a female threaded portion 74, and the driven rotor 60 is mounted to the power transmission member 70 by fastening means, as well as preventing the coil spring 81 and the powered rod 80 from being released.

Although the upper portion of the rod receiving hole is provided with a female threaded portion 74 to mount the driven rotor 60 and prevent the coil spring 81 and the powered rod 80 from being released, the invention is not limited to the above configuration. For example, any configurations known in the art may be employed to mount the driven rotor 60, and also any configurations known in the art may be employed to prevent the coil spring 81 and the rods 80 from being released by adjusting diameters of upper and lower portions of the rod receiving holes 73. These configurations do not correspond to the gist of the invention, and thus the detailed description will be omitted herein.

The upper portion of the first fitting protrusion 41 which is inserted into the protrusion receiving hole 71 of the power transmission member 70 is provided at the center thereof with a fastening hole 45 to which the holding bolt 46 is fastened. The lower portion of the first fitting protrusion 41 is provided with a protrusion body 42 having an outer diameter larger than an outer diameter of the first fitting protrusion 41. A top surface of the protrusion body 42 is provided with two seating holes 43 at two positions at an equal distance from the center of the first fitting protrusion 41. The seating holes 43 are formed at positions to receive front ends of the rods 80.

The protrusion body 42 is engaged to a protrusion body seating member 44 formed on the top surface of the cover cap 40 by fastening means, thereby precisely adjusting the foldable screens when the plurality of foldable screens 30 are aligned in a row. Also, the protrusion body 42 may be formed integrally with the protrusion body seating member 44.

The rotating force transmitted from the driven rotor 60 is transferred to the rods 80 via the power transmission member 70 to rotate the rods 80, and if the rods 80 are rotated, the rotating force is transferred to the protrusion body 42 in the state in which the front ends of the rods 80 are fitted into the seating holes 43. And thus, the protrusion body 42 is rotated, and the rotating force is transferred to the protrusion body seating member 44 to which the protrusion body 42 is engaged by the fastening means. Finally, if the protrusion body seating member 44 is rotated, the rotating force is transferred to the cover cap 40, and thus the foldable screen 30 is folded or unfolded.

FIGS. 9 and 10 are perspective views illustrating the configuration and operation of the driven rotor 60 according to the embodiment of the invention. As illustrated in an enlarged view indicated by the circle in FIG. 9, the driven rotor 60 is strongly mounted to the upper portion of the power transmission member 70 by fastening members, and one end of a traction bar 61 which comes in or out of the driven rotor 60 is mounted to the rail 55.

If the motor 53 is rotated in a direction of the arrow ① in FIG. 9, the rack gear 51 is linearly moved by the rotation of the pinion gear, and thus the main movable member 50 is linearly moved. In this instance, rollers 52 are mounted to a bottom surface of the main movable member 50 to easily move the main movable member 50.

The rail 55 is linearly moved in a direction of the arrow ② in FIGS. 9 and 10 in cooperation with the linear movement of the main movable member 50, and the driven rotor 60 is rotated in a direction of the arrow ③ by the movement of the rail 55. And thus, the traction bar 61 comes in or out of the driven rotor 60 in a direction of the arrow ④, and thus the foldable screen 30 is folded or unfolded in a direction of the arrow ⑤.

The traction bar 61 of the driven rotor 60 is configured to convert the linear movement of the rail 55 into the circular movement, and the driven rotor 60 is provided with a sliding hole 62 which penetrates the driven rotor 60 so as to avoid interference of rotation, as illustrated in FIG. 5C.

If the driven rotor 60 is rotated in a direction of the arrow ② in FIG. 5C, the traction bar 61 comes in or out of the sliding hole 62 in a direction of the arrow ③ to avoid the interference of rotation, so that the foldable screen 30 can be smoothly folded or unfolded.

FIG. 11 is a perspective view illustrating the function of the powered rod 80 of the power transmission member 70 according to the embodiment of the invention. The powered rod 80 is configured to transfer the rotating force transmitted from the power transmission member 70 to the lower portion for the purpose of safety of the customer.

Specifically, FIG. 11A shows the state in which the front end of the powered rod 80 inserted in the power transmission member 70 is fitted into the seating hole 43 of the protrusion body 42 under resilience of the coil spring 81. If the rotating force is transferred to the power transmission member 70 in the direction of the arrow ① under the state in FIG. 11A, the rotating force is transferred to the foldable screen 30, since the front end of the powered rod 80 is fitted into the seating hole 43. Therefore, the foldable screen 30 is rotated in the direction of the arrow ②.

If a dangerous situation affecting on the safety of customer happens, for example, a hand of the customer is held between the foldable screens 30 in the process of rotating the foldable screens 30, the rotating force is overloaded when the power transmission member 70 is rotated in the direction of the arrow ① in FIG. 11B.

The powered rod 80 is released from the seating hole 43 of the protrusion body 42, which is temporarily stopped by the external force, by the rotating force applied to the front end of the powered rod 80. If the rotating force of the powered rod 80 is influenced by the stopping force of the seating hole 43, the coil spring 81 is retracted, and thus the powered rod 80 is moved upwardly. Therefore, as the front end of the powered rod 80 is released from the seating hole 43, as illustrated in FIG. 11B, the foldable screens 30 are stopped even in a situation in which the power transmission member 70 is rotated, thereby keeping the safety of the customer at top priority.

If the dangerous situation is over, the plurality of foldable screens 30 can be aligned by swinging the foldable screens 30 left and right with hands so that the front ends of the powered rods 80 are again fitted into the seating holes 43.

As illustrated in FIGS. 2, 5A and 5B, rotation stoppers 91 are mounted to the lower frame 22. The rotation stoppers 91 are configured to prevent the foldable screens 30 from being further rotated and protruding forwardly from the showcase in the state in which the foldable screens are unfolded.

In view of the configuration in which when the external force is applied to the foldable screen 30, the corresponding foldable screen 30 is not further rotated for the purpose of the safety of the customer, the position of the foldable screen 30 according to the embodiment of the invention is temporarily varied according to the external force.

The position of the foldable screen 30 can be intentionally varied by holding it with the hand even in any situation which is not an accident, the rotation stoppers 91 are mounted to the lower frame 22 to maintain the foldable screens in an aligned close state. Preferably, the rotation stopper 91 is operated like a push-button, so as to easily separate the foldable screens 30.

As illustrated in FIGS. 5A and 5B, a spacer 90 is mounted to the upper frame 20 to maintain an interval between the foldable screens which are fully folded toward the inside of the showcase.

As described above, the position of the foldable screen 30 according to the embodiment of the invention can be intentionally varied by holding it with the hand even in any situation which is not an accident. Therefore, in order to prevent the position of the foldable screen 30 from being varied, the spacer 90 is mounted to the upper frame 20 to continuously maintain the open state of the foldable screens which are aligned to be folded.

FIG. 12 is a perspective view illustrating the automatic foldable door according to the embodiment of the invention is detachably installed to the open-type showcase. If the automatic foldable door of the detachable type for the showcase is employed, it is possible to protect various kinds of foods and beverages put on the showcase against alien substances coming from the outside, thereby keeping the display state more clean and fresh, to solve the problem in that the cold air for improving the freshness is excessively discharged to the outside, thereby reducing the amount of electricity used, and to easily get the advertising effect of various kinds of foods and beverages put on the showcase through the surface of the transparent foldable screens.

In addition, when the hand of the customer is held between the foldable screens which are automatically rotated, the rotating force applied to the foldable screens is rapidly extinguished to secure the safety of the customer. Also, in view of the configuration of which the automatic foldable door of the invention can be detachably installed to the conventional showcase, it is possible to provide the customers with further improved service by use of the existing facility.

EXPLANATIONS ON REFERENCE NUMERALS

10: showcase
11: display shelves
12: display space
13: machine chamber
14: cover
15: sensor
20: upper frame
21: rail grooves
22: lower frame
23: fitting holes
30: foldable screens
40: cover cap
41: first fitting protrusion
42: protrusion body
43: seating holes
44: protrusion body seating member
45: fastening hole
46: holding bolt
47: second fitting protrusion
50: main movable member
51: rack gear
52: rollers
53: motor
54: pinion gear
55: rail
60: driven rotor
61: traction bar
62: sliding hole
70: power transmission members
71: protrusion receiving hole
72: locking shoulder
73: rod receiving holes
74: female threaded portion
80: powered rod
81: coil spring
90: spacer
91: rotation stopper

What is claimed is:

1. An automatic detachable door of a detachable type for a showcase, the automatic detachable door comprising:

a plurality of foldable screens (30), of which a cover cap (40) is respectively fitted into upper and lower portions of the respective foldable screens (30), a first fitting protrusion (41) is mounted to one side of the upper cover cap (40), and a second fitting protrusion (47) is mounted to one side of the lower cover cap (40); and upper and lower frames (20 and 22) which are provided with a plurality of fitting holes (23) at a certain interval, wherein power transmission members (70) are fitted into the fitting holes (23) of the upper frame (20);

a center of the power transmission member (70) is provided with a protrusion receiving hole (71) for receiving the first fitting protrusion (41);

rod receiving holes (73) are formed at symmetric positions at an equal distance from a center the protrusion receiving hole (71);

a coil spring (81) and a powered rod (80) are sequentially inserted into the respective rod receiving holes (73);

an upper portion of the protrusion receiving hole (71) is provided with a locking shoulder (72) on which a holding bolt (46) for holding the first fitting protrusion (41) is seated;

an upper portion of the first fitting protrusion (41) is provided at a center thereof with a fastening hole (45) to which the holding bolt (46) is fastened;

a lower portion of the first fitting protrusion (41) is provided with a protrusion body (42) having an outer diameter larger than an outer diameter of the first fitting protrusion (41);

a top surface of the protrusion body (42) is provided with two seating holes (43) at two symmetric positions at an equal distance from the center of the first fitting protrusion (41), in which the seating holes (43) are formed to receive front ends of the rods (80);

the protrusion body (42) is engaged to a protrusion body seating member (44) formed on a top surface of the cover cap (40); and the plurality of foldable screens (30) are simultaneously opened or closed by a rotating member mounted to the upper frame (20).

2. The automatic detachable door of the detachable type for the showcase according to claim 1, wherein a spacer (90) is mounted to the upper frame (20) to maintain an interval between the foldable screens (30) which are fully folded toward an inside of the showcase, and rotation stoppers (91) are mounted to the lower frame (22) to prevent the foldable screens (30) from being further rotated and protruding forwardly from the showcase in a state in which the foldable screens are unfolded.

3. The automatic detachable door of the detachable type for the showcase according to claim 1 or 2, wherein the rotating member is mounted to the upper frame (20);

both inner sides of the upper frame (20) are provided with a pair of rail grooves (21), and a rail (55) is mounted on the respective rail grooves (21);

a main movable member (50) is engaged to the upper portion of the respective rails (50);

a top surface of the main movable member (50) is provided with a rack gear (51), and the rack gear (51) is meshed with a pinion gear (54) of a motor (53);

rollers (52) are mounted to a bottom surface of the main movable member (50);

a driven rotor (60) is mounted to an upper portion of the respective power transmission members (70);

the driven rotor (60) is provided with a sliding hole (62) which penetrates the driven rotor (60); and one end of a traction bar (61) which comes in or out of the sliding hole (62) is engaged to the rail (55), so that the driven rotor (60) is rotated by operation of the main movable member (50) to simultaneously open or close the plurality of foldable screens (30).

* * * * *